US006854799B1

(12) United States Patent
Asbach et al.

(10) Patent No.: US 6,854,799 B1
(45) Date of Patent: Feb. 15, 2005

(54) COLLAPSIBLE INFANT ENTERTAINMENT DEVICE

(75) Inventors: Ronald M. Asbach, Grand Island, NY (US); Domenic T. Gubitosi, East Aurora, NY (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/772,336

(22) Filed: Feb. 6, 2004

(51) Int. Cl.[7] ..... A47D 13/04; A47B 83/02
(52) U.S. Cl. ..... 297/136; 297/5
(58) Field of Search ..... 297/5, 136

(56) References Cited

U.S. PATENT DOCUMENTS

| | | | | |
|---|---|---|---|---|
| 131,349 | A | | 9/1872 | Holmes |
| 616,697 | A | | 12/1898 | Cowles et al. |
| 707,774 | A | | 7/1902 | Blackledge |
| 1,326,921 | A | | 1/1920 | Dzimitowicz |
| 1,806,454 | A | | 5/1931 | Goudeau |
| 1,931,567 | A | | 10/1933 | Arends |
| 1,950,042 | A | | 3/1934 | Upper |
| 2,006,492 | A | | 7/1935 | Van Santen |
| 2,282,086 | A | * | 5/1942 | Peltier ..... 280/87.05 |
| D137,437 | S | | 3/1944 | Driscoll |
| 2,347,754 | A | | 5/1944 | Shay |
| 2,521,422 | A | | 9/1950 | Strand, Jr. et al. |
| 2,855,023 | A | | 10/1958 | Mekeel et al. |
| 3,029,551 | A | | 4/1962 | Reiskin |
| 3,462,113 | A | | 8/1969 | MacLeod |
| 3,747,596 | A | | 7/1973 | Mills |
| 3,765,674 | A | | 10/1973 | Siler |
| 3,796,430 | A | * | 3/1974 | Sudo ..... 297/5 X |
| 3,992,023 | A | | 11/1976 | Moorer |
| 4,025,083 | A | * | 5/1977 | Saint ..... 297/5 X |
| 4,045,045 | A | * | 8/1977 | Boucher et al. ..... 297/5 X |
| 4,094,547 | A | | 6/1978 | Zampino et al. |
| 4,140,311 | A | * | 2/1979 | Murakami ..... 297/5 X |
| 4,141,095 | A | | 2/1979 | Adachi |
| 4,171,132 | A | * | 10/1979 | Kassai ..... 297/5 X |
| 4,171,847 | A | * | 10/1979 | Tukui ..... 297/5 |
| 4,225,146 | A | * | 9/1980 | Takeuchi ..... 297/5 X |
| 4,231,582 | A | * | 11/1980 | Moss ..... 297/5 X |
| 4,298,228 | A | | 11/1981 | Zampino et al. |
| 4,359,045 | A | | 11/1982 | Cozzi |
| 4,359,242 | A | * | 11/1982 | Gerken et al. ..... 297/5 |
| 4,364,576 | A | * | 12/1982 | Kassai ..... 297/5 X |
| 4,553,786 | A | | 11/1985 | Lockett, III et al. |
| 4,576,392 | A | * | 3/1986 | Quinlan, Jr. ..... 297/5 X |
| 4,615,523 | A | * | 10/1986 | Chen ..... 297/5 X |
| 4,699,392 | A | * | 10/1987 | Ku ..... 297/5 X |
| 4,822,030 | A | * | 4/1989 | Cone ..... 297/5 X |
| 4,948,120 | A | | 8/1990 | Krueger et al. |
| 5,052,749 | A | | 10/1991 | Groenendijk |
| 5,054,851 | A | * | 10/1991 | Chiu ..... 297/136 |
| D327,777 | S | | 7/1992 | Tepper |
| 5,156,176 | A | * | 10/1992 | Doorenbos ..... 297/5 X |
| 5,172,955 | A | | 12/1992 | Freese et al. |
| 5,201,693 | A | | 4/1993 | Sparkes |

(List continued on next page.)

FOREIGN PATENT DOCUMENTS

| | | |
|---|---|---|
| CA | 497983 | 12/1953 |
| DE | 3304443 A1 | 8/1984 |

*Primary Examiner*—Rodney B. White
(74) *Attorney, Agent, or Firm*—Cooley Godward LLP

(57) ABSTRACT

An infant support structure includes a base, a frame coupled to the base, a seat coupled to the frame for movement relative to the base, a motion sensor configured to output a signal associated with a movement of the seat relative to the base, and an output generating system. The frame includes a first frame portion and a second frame portion with the first frame portion being releasable coupled to the seat and pivotably coupled to the base. The output generating system is configured to generate sensible output based on the signal.

24 Claims, 8 Drawing Sheets

U.S. PATENT DOCUMENTS 5,207,478 A 5/1993 Freese et al.
5,407,246 A 4/1995 Meeker et al.
5,451,093 A 9/1995 Petrie et al.
5,490,711 A 2/1996 Pollock
D376,052 S 12/1996 Cone et al.
D378,554 S 3/1997 Meeker et al.
5,615,428 A 4/1997 Li
5,645,489 A 7/1997 Laiche et al.
5,688,211 A 11/1997 Myers
5,690,383 A 11/1997 Meeker
5,700,201 A 12/1997 Bellows et al.
5,704,576 A 1/1998 Meeker et al.
5,704,882 A 1/1998 Coates et al.
5,728,030 A 3/1998 Hsieh
D395,467 S 6/1998 Bellows
5,857,944 A 1/1999 Cone et al.
5,868,459 A 2/1999 Welsh, Jr.
5,876,311 A 3/1999 Coates et al.
5,934,747 A 8/1999 Garland
5,975,628 A 11/1999 Russell
6,030,039 A 2/2000 Essler
6,036,604 A 3/2000 Klitsner
6,048,290 A 4/2000 Chen et al.
6,170,840 B1 1/2001 Mathias
6,179,376 B1 1/2001 Meeker et al.
6,244,606 B1 * 6/2001 Yang ..... 297/5 X
6,299,247 B1 10/2001 Meeker et al.
6,383,085 B1 5/2002 Tseng
6,520,862 B1 2/2003 Armbruster et al.
6,540,579 B1 * 4/2003 Cimerman et al. ..... 297/136 X
6,648,411 B2 11/2003 Julien
2002/0002741 A1 1/2002 Tomas et al.
2002/0027382 A1 3/2002 Bellows et al.
2002/0043824 A1 4/2002 Bellows et al.
2002/0043825 A1 4/2002 Bellows et al.
2002/0115535 A1 8/2002 Stern et al.
2002/0164917 A1 11/2002 Keegan et al.
2003/0020317 A1 1/2003 Keegan et al.
2003/0222421 A1 12/2003 Myers et al.
2004/0119258 A1 6/2004 Yoo (List continued on next page.)

COLLAPSIBLE INFANT ENTERTAINMENT DEVICE

BACKGROUND

The invention relates generally to children's entertainment toys, and more particularly to infant's entertainment toys that can be easily collapsed for storage and transportation.

There are numerous children's toys and activity centers that are useful to entertain and stimulate children. Walkers and entertainment centers that encourage infants to push with their feet are often difficult for the infant to use. These devices, moreover, do not normally have audio and visual feedback to keep a child's attention, requiring the addition of other stimuli to attract the child's attention.

Walkers and entertainment centers can also be cumbersome and difficult to store and transport. The size of entertainment centers makes them difficult to store, and it is difficult to find a suitable location when in use. Such entertainment centers cannot be easily transported, limiting their usefulness to a home setting.

Thus, there is a need for a device that is entertaining and can aid in the development of an infant, and is also easily collapsible for storage and transportation.

SUMMARY OF THE INVENTION

An infant support structure includes a base, a frame coupled to the base, a seat coupled to the frame for movement relative to the base, a sensor configured to output a signal associated with a movement of the seat, and an output generating system. The frame includes a first frame portion and a second frame portion. The first frame portion is releasably coupled to the seat and pivotably coupled to the base. The output generating system is configured to generate sensory output based on the signal.

In one or more embodiments of the invention, the device can include a variety of actuators and output, such as audio and visual output. The output can include, for example, sounds, lights, or other visual images.

These and other aspects of the invention will become apparent from the following drawings and description.

BRIEF DESCRIPTION OF THE DRAWINGS

The invention is described with reference to the accompanying drawings. In the drawings, like reference numbers indicate similar elements.

DETAILED DESCRIPTION

One or more embodiments of a children's entertainment device or toy incorporating the principles of the invention are shown in FIGS. 1—13. A general and functional description of such a device is presented first, followed by a more detailed description of various implementations of such a device.

Figure 1A:
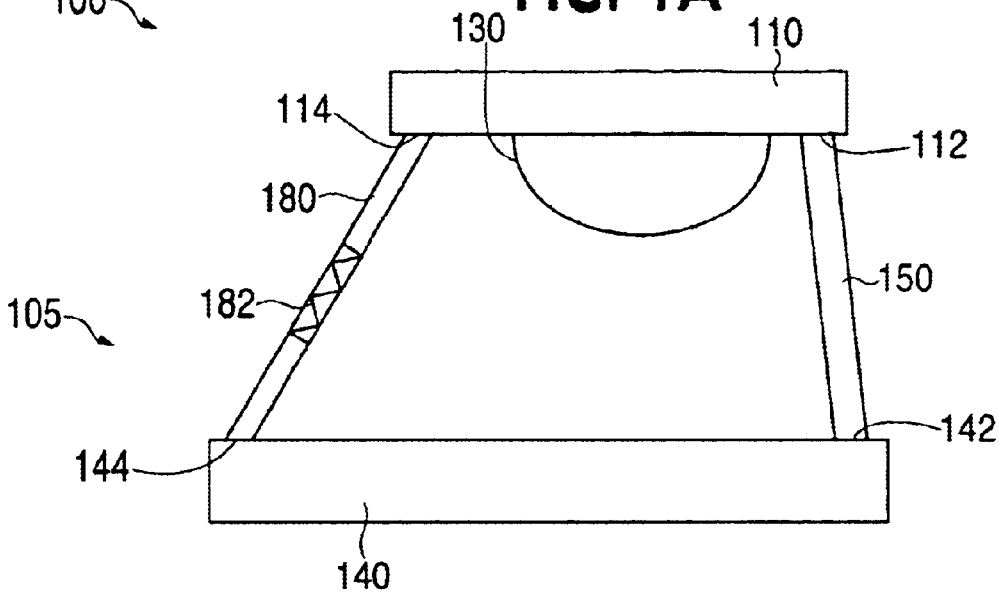
FIG. 1A is a schematic illustration of a device in a first configuration according to an embodiment of the invention.
Figure 1B:
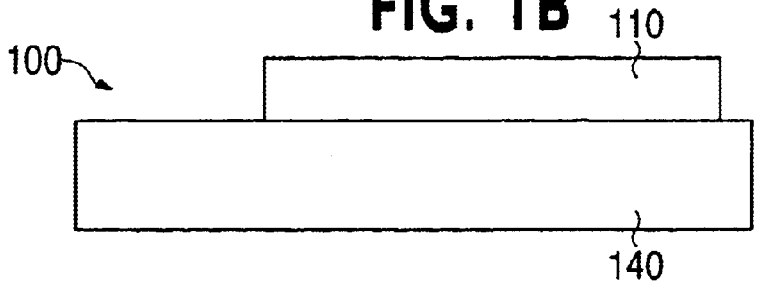
FIG. 1B is a schematic illustration of the device of FIG. 1A in a second configuration.

FIGS. 1A and 1B are schematic illustrations of an embodiment of a device 100 in a first, deployed configuration and a second, collapsed configuration, respectively. Device 100 includes a frame 105 with a tray 110, a seat 130, a base 140, and support legs 150, 180. Base 140 is a ground-engaging base for the device. Each of support legs 150, 180 are coupled to base 140 at their lower ends by base couplings 142, 144, respectively. Tray 110 is coupled to upper ends of support legs 150, 180 by tray couplings 112, 114, respectively. Seat 130 is supported on (or suspended from) tray 110. As shown in FIG. 1A, support legs 150, 180 support tray 110 and seat 130 above base 140. A user, such as an infant, can be placed in seat 130 with access to tray 110, including any entertainment features thereon, and with the user's feet engaging or dangling above base 140 or a supporting surface, such as a floor.

Further entertainment for the user can be achieved by configuring one or both support legs, 150, 180 with a spring (and optionally a damper) to compress and expand in response to motion of the user. For example, jumping up and down by pushing off from base 140 or support surface, simply jostling the seat or tray, or other movements. Thus, in FIG. 1A, support leg 180 is illustrated schematically as including a spring element 182. To allow the change in relative orientation of tray 110 and base 140 arising from a change in the length of support leg with a spring, couplings 112, 114, 142, 144 can be a variety of types (including pivotal or fixed, with releasable or fixed connections). Additionally, support legs 150, 180 can be flexible or jointed. Thus, for example, front support leg 150 can be a compressible leg pivotably coupled to base 140 and rigidly (but releasably, as explained below) coupled to tray 110, and rear support leg 180 can be pivotably coupled to base 140 and releasably coupled to tray 110.

As shown in FIG. 1B, device 100 can be disposed in a collapsed or stored configuration, in which tray 110 and seat 130 are disposed adjacent to base 140, with support legs 150, 180 disposed between or adjacent tray 110 and/or base 140. Device 100 is thus in a more compact configuration in which it can be more easily transported and/or stored. The transition between the first, useable or deployed configuration of device 100 as shown in FIG. 1A, and the second, collapsed or stored configuration shown in FIG. 1B is enabled by the arrangement of support legs 150, 180 and tray couplings 112, 114 and base couplings 142, 144 by which they are coupled to tray 110 and base 140, respectively. Thus, for example, base coupling 144 can provide a releasable, but fixed, connection between the lower end of support leg 180 and base 140, while tray coupling 114 can provide a pivotal connection between the upper end of support leg 180 and tray 110. Similarly, base coupling 142 and tray coupling 112 could both provide pivotal connections. Device 100 could thus be changed from the deployed configuration to the stored configuration by releasing base coupling 144, pivoting support leg 180 to a position between base 140 and tray 110, and moving tray 110 toward and onto base 140, pivoting on front support leg 150.

Figure 2:
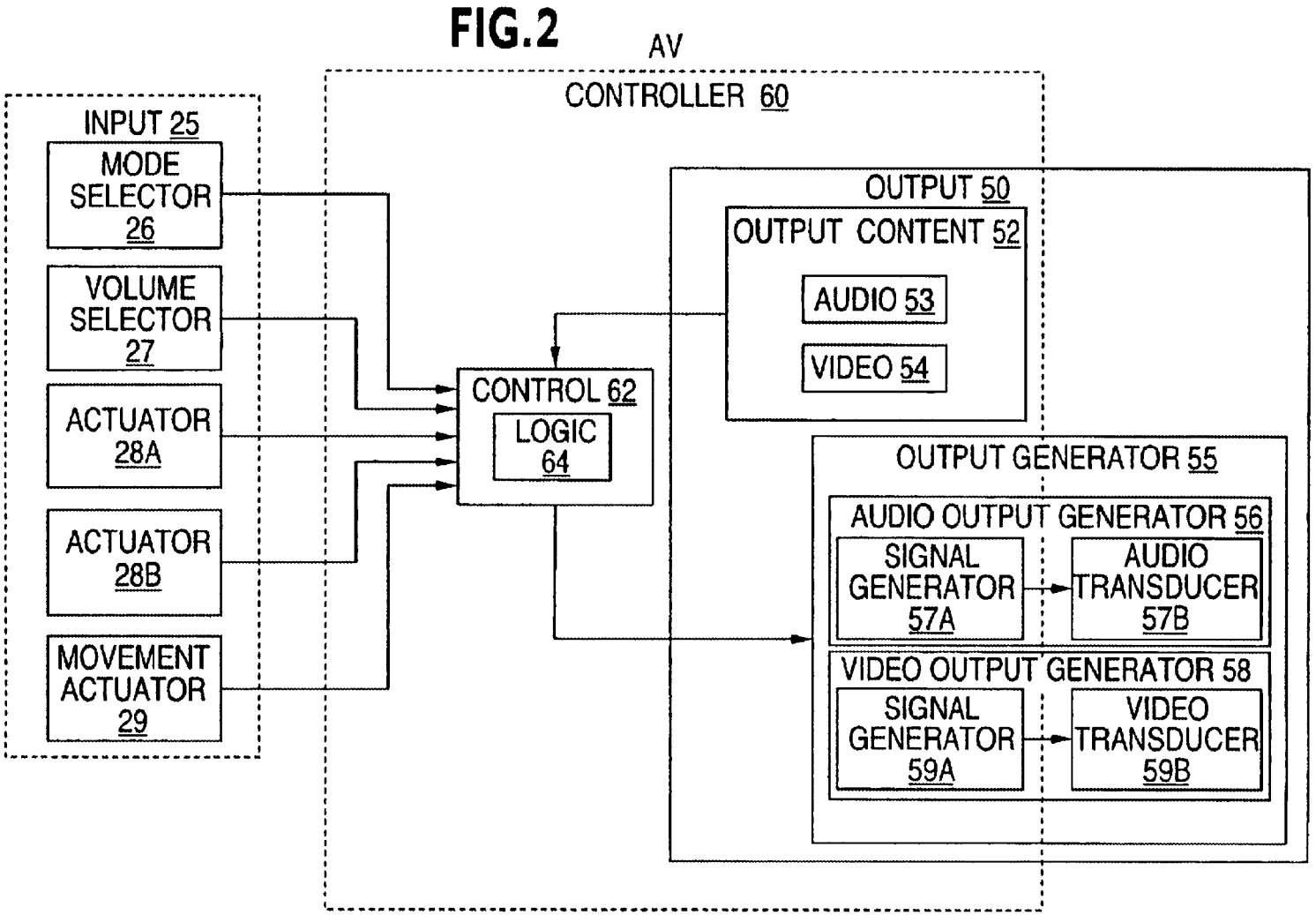
FIG. 2 is a block diagram illustrating the relationship of various components of a device according to an embodiment of the invention.

Device 100 described above can include an audio-visual output system to provide entertainment and stimulation to the user. FIG. 2 shows a functional block diagram of an exemplary audio-visual output system AV suitable for use with device 100. As shown in FIG. 2, system AV includes a controller 60, an input block 25, a control block 62, and an output block 50. In response to user input via input block 25, control block 62 controls the output of selected output, such as musical notes, sound effects, light patterns or combinations of musical notes and light patterns, from output block 50.

Output block 50 includes output content 52, which includes audio content 53, and video content 54. Audio content 53 can include, for example, in either digital or analog form, musical tones (which can be combined to form musical compositions), speech (recorded or synthesized), or sounds (including recorded natural sounds, or electronically synthesized sounds). Video content 54 can include, for example, in analog or digital form, still or video images, or simply control signals for activation of lamps or other light-emitting devices.

The output content can be communicated to a user for hearing, or viewing, by output generator 55, which can include an audio output generator 56, and a video output generator 58. Audio output generator 56 can include an audio signal generator 57A, which converts audio output content 53 into signals suitable for driving an audio transducer 57B such as a speaker, for converting the signals into audible sound waves. Video output generator 58 can include a video signal generator 59A, which converts video output content 54 into signals suitable for driving a video transducer 59B, such as a display screen or lights, for converting the signals into visible light waves. Video output generator 58 can also include moving physical objects, such as miniature figures, to produce visual stimulus to the user. The selection of the output content 52, and the performance attributes of the output generators, should be driven by the goal of generating output that is appealing or entertaining to a child user.

Control block 62 controls output block 50, selecting the output content to be output and activating the output generator 55 to operate on the selected output content. The operation of control block 62 can be governed by control logic 64, which can be, for example, computer software code. Control logic 64 can select content to be output repetitively or non-repetitively, and/or randomly or in fixed sequences. The video and audio output can be coordinated to enhance the desired entertaining effect. For example, a routine of audio content 53 and video content 54 could be varied according to the frequency, order, and consistency of the input from the user into the various elements in the input block 25.

User input block 25 can include a mode selector 26, a volume selector 27, one or more actuators 28A, 28B, and a movement actuator 29, described below, by which the user can provide input to control block 62 to influence the selection of output content and to initiate its output. The movement actuator 29 detects movement of the tray 110 with respect to the base 140. Mode selector 26 allows the user to select from among output modes. Illustrative output modes include variations of combined video and audio output. For example, the audio content 53 can include a set of musical tones and a set of sound effect segments, and the video content 54 can include a selected sequence of illumination instructions for lamps. Control logic 64 includes sets of sequences in which the musical tones can be output to produce recognizable tunes. Various modes of light operation (i.e., direction of light transmission) can be selected. A program can include a predetermined sequential output of the sets of tone sequences, producing a sequence of musical tunes. Video transducers 59B, such as lights, can be illuminated in response to a set of illumination instructions correlated with the playing of the tunes.

A device 200 embodying the principles illustrated schematically in FIGS. 1A and 1B is illustrated in FIGS. 3–7. Device 200 includes a frame 205 with a base 240, tray 210, a front support leg 250, a rear support 280, and a seat 230.

In the embodiment illustrated in FIGS. 3–7, base 240 is a ground-engaging device that includes a front base member 246A and side base members 246B, 246C. Coupling 242 for connection with front support leg 250 is located on front frame base 246A. Side base members 246B, 246C are connected to opposite ends front base member 246A and extend rearward and connect with base couplings 244A, 244B, defining a space enclosed by base members 246A, 246B, 246C. Front base member 246A and base couplings 244A, 244B can include slip resistant members 247 (such as rubber pads or feet) at points of ground engagement to prevent device 200 from sliding or accidentally moving into a dangerous location by the motion of a child occupant.

Foot guard 248 is positioned in the space between side base members 246B, 246C, behind front base member 246A, and below seat 230. Foot guard 248 allows device 200 to be used on a variety of surfaces by protecting a child's feet from dirt, bugs and uncomfortable surfaces. Foot guard 248 also prevents the child from propelling device 200, to a potentially unsafe or otherwise undesired location. Foot guard 248 can also be removable for cleaning and replacement as needed. Foot guard 248 can be made of soft goods, plastic or any other suitable material.

In the illustrated embodiment, rear support 280 includes two rear support legs 284, 286 pivotably coupled to side base members 246B, 246C by base couplings 244A, 244B. Each rear support leg 284, 286 extends upwardly from base 240 and is coupled to tray 210 at tray couplings 214A, 214B. A single front support leg 250 is pivotably coupled to base 240 at base coupling 242. Front support leg 250 extends upwardly and is releasably coupled with tray 210 at tray coupling 212, described in detail below.

Figure 6:
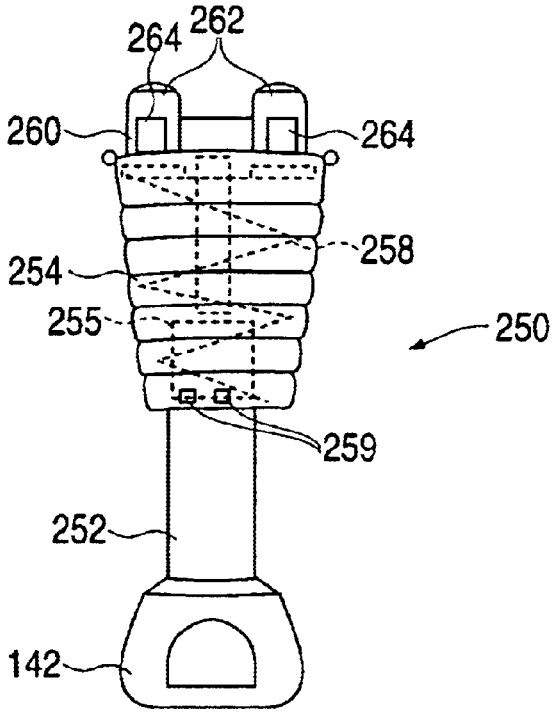
FIG. 6 is a front view of a front support leg of the device illustrated in FIG. 3.
Figure 7:
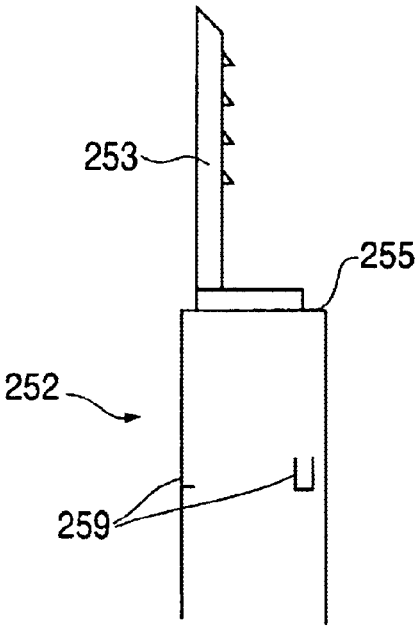
FIG. 7 is a side view of the lower leg of the front support leg illustrated in FIG. 6.
Figure 8:
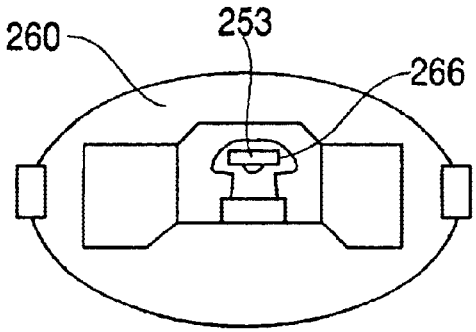
FIG. 8 is a top view of the front support leg illustrated in FIG. 6.

FIGS. 6–8 illustrate an embodiment of front support leg 250. As illustrated, front support leg 250 includes lower leg 252, boot 254, upper engagement member 260 and spring 258. At the bottom end, lower leg 252 includes base coupling 242. At the upper end, rack 253 extends from the spring shelf 255 located at the upper end of lower leg 252. Spring shelf 255 supports spring 258. The upper end of spring 258 is engaged with upper engagement member 260.

Upper engagement member 260, spring 258 and rack 253 can are concealed by boot 254, which is coupled to upper engagement member 260 and configured to slide along the body of lower leg 252 below protrusions 259. Protrusions 259 prevent boot 254 from disengaging from lower leg 252 when boot 254 or upper engagement member 260 is pulled upward away from lower leg 252. When upper engagement member is pushed downward or depressed, spring 258 is compressed, and boot 254 slides downward along lower leg 252. When upper engagement member 260 is depressed, rack 253 extends from opening 266 in upper engagement member 260.

Figure 5:
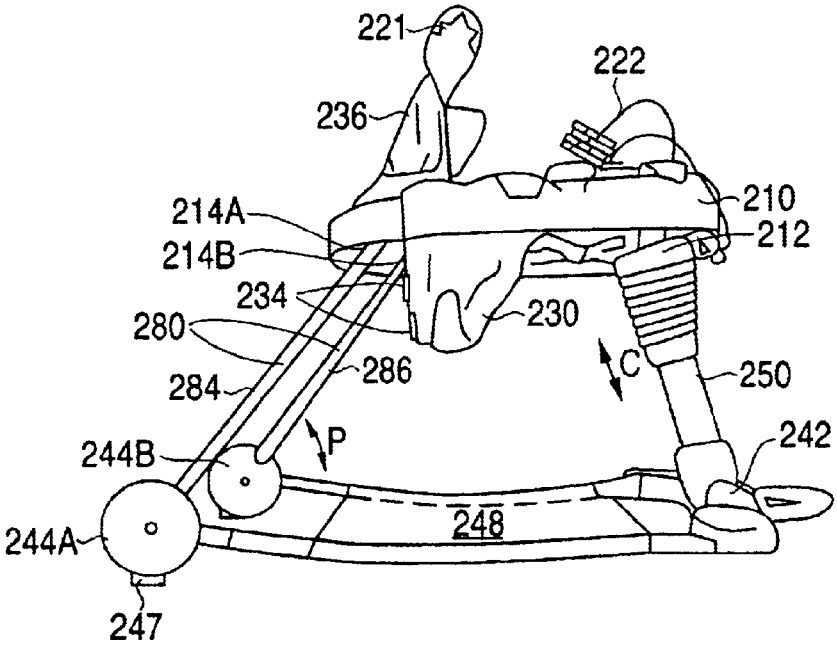
FIG. 5 is a side view of the device illustrated in FIG. 3.

As shown in FIG. 5, tray 210 includes seat 230, tray couplings 212, 214A, 214B, and entertainment devices 221–226. In the illustrated embodiment, tray 210 also houses audio-visual output system AV.

Tray 210 is coupled to rear support legs 284, 286 at tray couplings 214A, 214B. Couplings 214A, 214B are releasably connected with rear support legs 284, 286. Rear support legs 284, 286 slidably engage with sockets (not shown) and are held in place with a spring-pin device (not shown). When attached, rear support 280 is fixedly coupled to tray 210, preventing relative movement between rear support 280 and tray 210. Thus, tray 210 can pivot with respect to base 240 through pivoting base couplings 244A, 244B.

Figure 9:
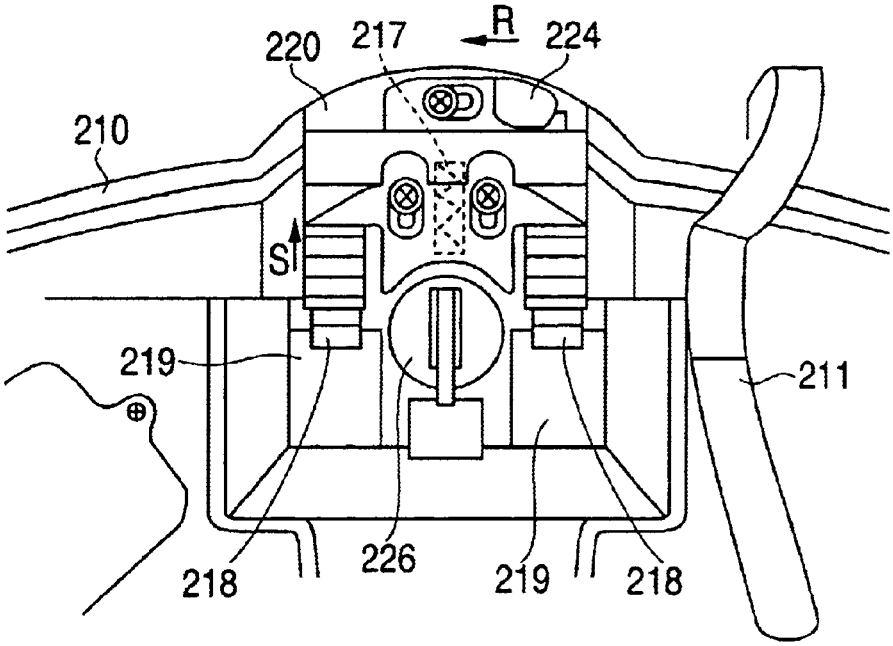
FIG. 9 is a bottom view of an unengaged release mechanism of the device illustrated in FIG. 3.
Figure 10:
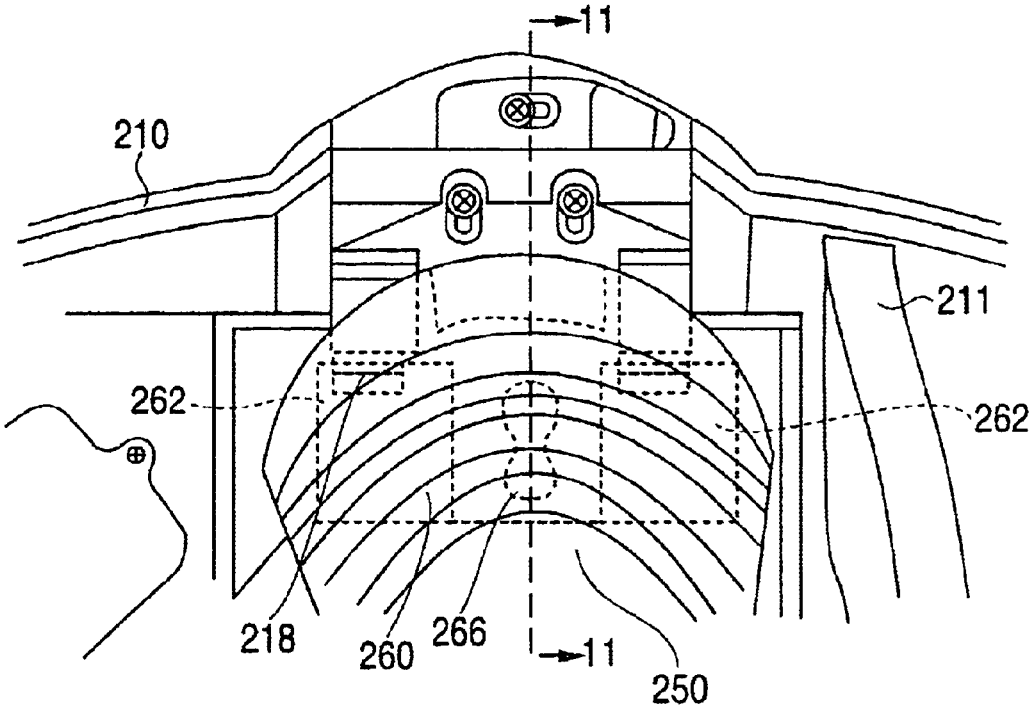
FIG. 10 is a bottom view of an engaged release mechanism of the device illustrated in FIG. 3.

FIGS. 9 and 10 illustrate tray coupling 212 where front support leg 250 connects to tray 210, and a portion of corn popper mechanism 226, described below in further detail.

To connect front support leg 250 with tray 210 in the illustrated embodiment, engagement extensions 262 of upper engagement member 260 are inserted into extension wells 219 on the bottom of tray 210. Engagement pins 218, biased into an extended configuration by return spring 217, retract when upper engagement member 260 is pressed into extension wells 219 until engagement extension member eyes 264 are aligned with engagement pins 218. When aligned, return spring 217 forces engagement pins 218 to extend into engagement with extension member eyes 264, holding front support leg 250 in position. When front support leg 250 is held in position, a small amount of pivoting is allowed in tray coupling 212 between front support leg 250 and tray 210.

To release front support leg 250 from tray 210, safety release 224 is moved in direction R, shown in FIG. 9, moving a shield from a safety pin (not shown) allowing release handle 220 to be pulled in direction S indicated in FIG. 8, removing the engagement pins 218 from engagement extension member eyes 264 and allowing front support leg 250 to be uncoupled from tray 210.

In the illustrated embodiment, seat 230 is supported and surrounded by tray 210. As best seen in FIG. 5, seat 230 includes adjustment device 234 to adjust the height of seat 230 to allow children of different sizes to reach foot guard 248 and bounce in device 200. Adjustment device 234, as illustrated, includes a male clip located at the bottom of seat 230 with female clips located at different heights up the back of seat 230 for adjusting seat 230 with respect to base 240 and foot guard 248.

Seat 230 includes a foldable support portion 236, which gives support for a child in seat 230, protecting the child's head from leaning backwards. Seat 230 can be made of soft goods and is removable from tray 210 to be cleaned and replaced as needed.

In the illustrated embodiment, tray 210 includes various items and toys to entertain a child. The various toys and entertainment devices disposed on tray 210 are: upright teething toys 221, slide ring with slidable characters 222, rocker switch 223, rotating ball 224, dial actuator 225, corn popper 226, described in detail below, and lights 59B. Lights 59B can correlate with the video transducers 59B of the exemplary audio-visual system described above and shown in FIG. 2. Similarly, actuators that correlate to input actuators 28A, 28B of the system of FIG. 2, can also be included in the toys, such as the slide ring 222, rocker switch 223, rotating ball 224, and other toys to cause an audio and/or visual output when the toys 221-226 are moved or played with. Mode selector 26 and volume selector 27 are located in tray 210 to activate and adjust the audio-visual system AV.

Figure 3:
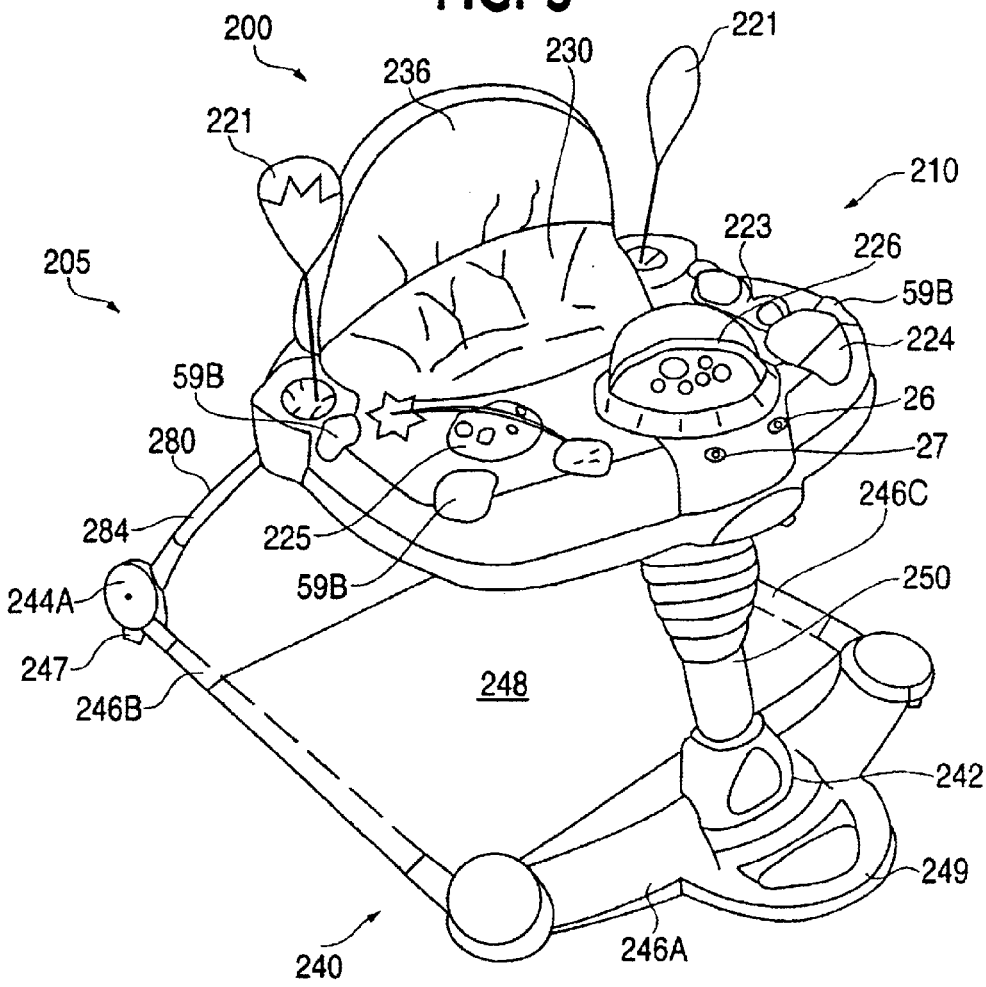
FIG. 3 is a perspective view of a device in a first configuration according to another embodiment of the invention.
Figure 4:
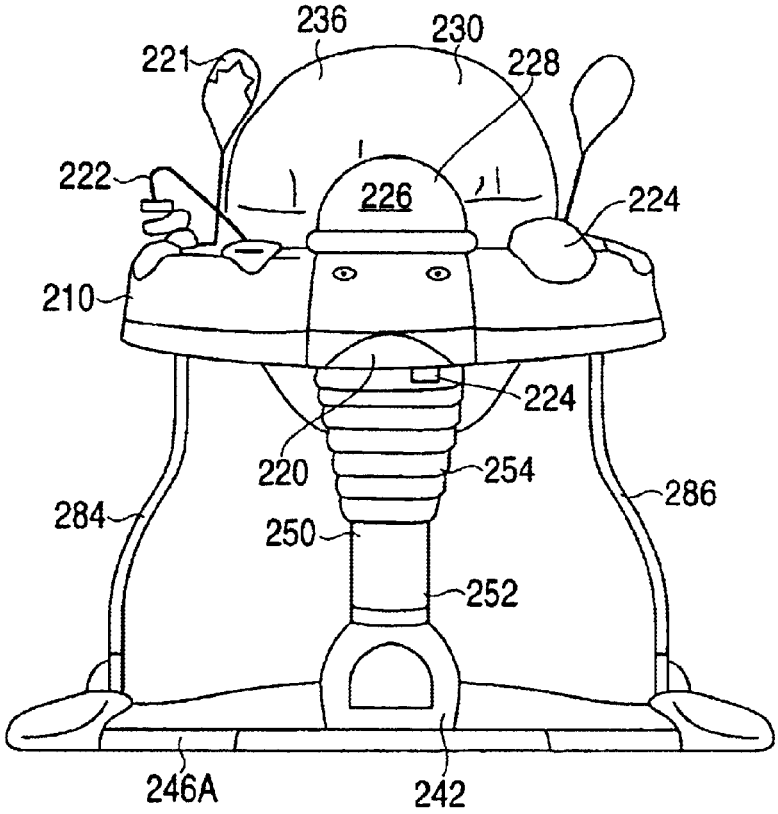
FIG. 4 is a front view of the device illustrated in FIG. 3.

In the usable configuration illustrated in FIGS. 3–5, base 240 is pivotably coupled to rear support 280 and pivotably coupled to front support leg 250. Rear support 280 is fixedly coupled to tray 210, and front support leg 250 is connected with a small amount of pivoting allowed. This attachment configuration allows front support leg 250 to be compressed, as shown by arrow C, when force is applied downward to tray 210, such as a bouncing child in seat 230. When tray 210 is forced downward, front support leg 250 is compressed and tray 210 pivots, as shown by arrow P, with respect to base 240 about base couplings 244A, 244B. Spring 258 returns tray 210 to an extended position when a downward force input is removed. Thus, a child bouncing in device 200 will lower tray 210 when bouncing and spring 258 will return tray 210 to an upper position.

Figure 11:
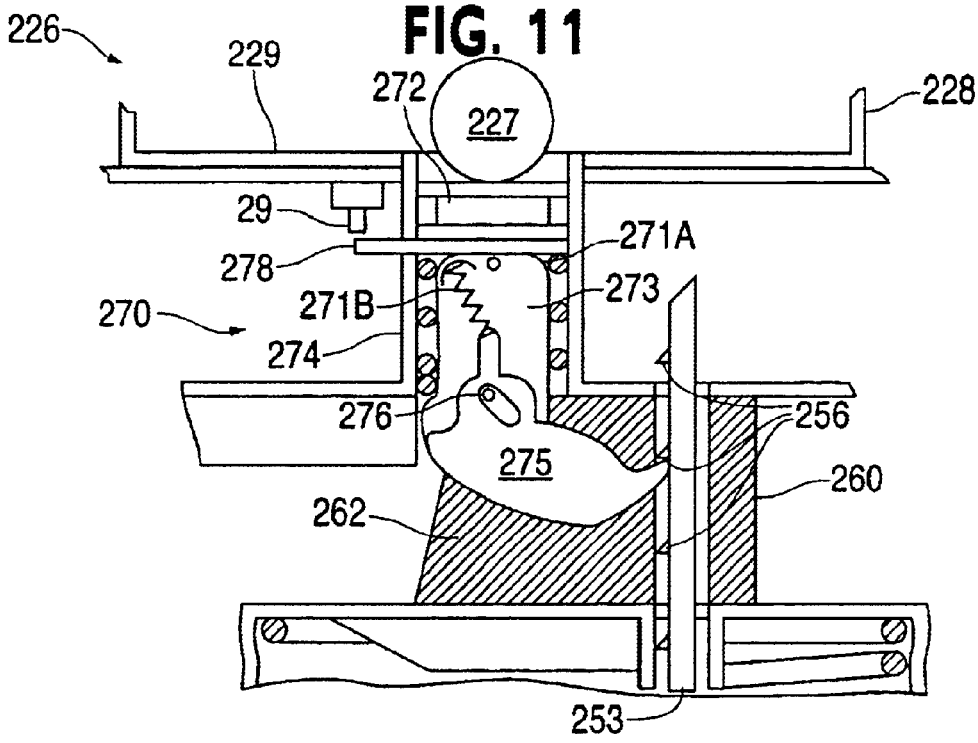
FIGS. 11 and 12 are cross-sectional views taken along lines 11—11 in FIG. 10.
Figure 12:
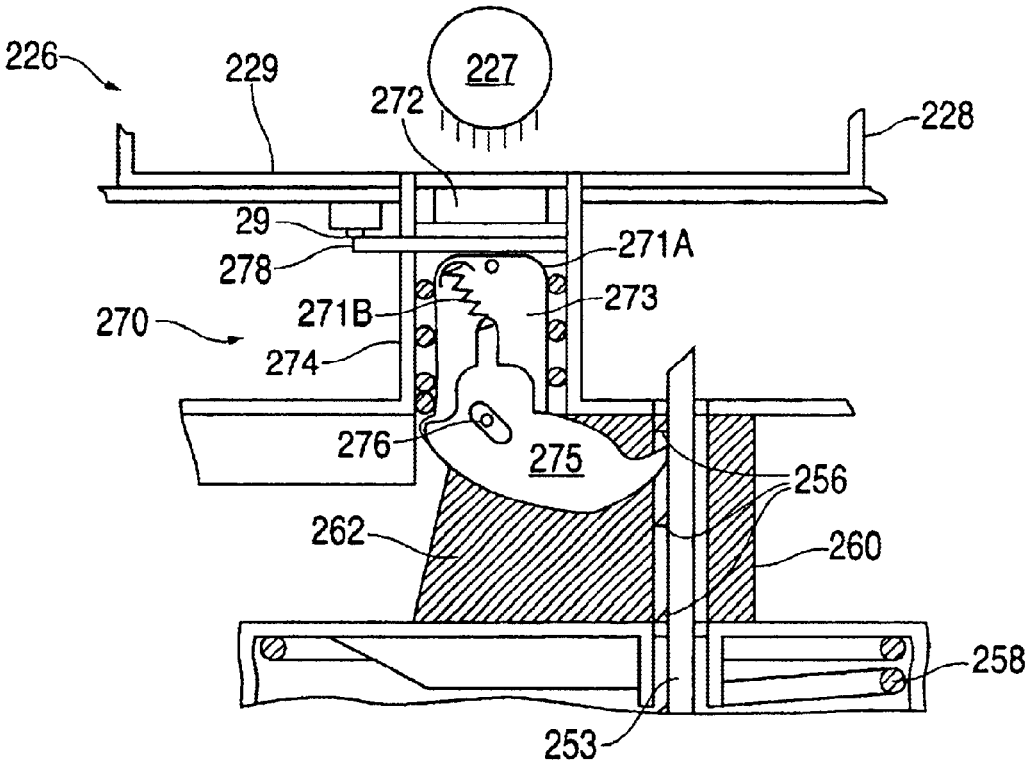

The compression of front support leg 250 activates corn popper 226 and movement actuator 29. FIGS. 11 and 12 illustrate the function of corn popper 226 when front support leg 250 is compressed. Corn popper 226 functions when popper mechanism 270 is pulled downward, resisted by springs 271A, 271B, and subsequently released. When released, popper mechanism 270 is urged upward by springs 271A, 271B, thereby "popping" balls 227 up an into popper dome 228. The "popping" action creates a visual output of balls 227 bouncing about in popper dome 228 with sounds emitted when popper mechanism 270 is activated and when balls 227 strike popper dome 228.

In the initial position, as shown in FIG. 12, the top of popper body 272 is level with popper base 229. Connector arm 273 is pivotally coupled to popper body 272. Popper body 272 and connector arm 273 are disposed in popper well 274. Extensions in popper well 274 and on connector arm 273 prevent popper body 272 from extending above the position shown in FIG. 12.

In the illustrated embodiment, when front support leg 250 is compressed, rack 253 extends out of the upper engagement member 260 of front support leg 250, engages popper mechanism 270 through popper hook 275 and then extends into tray 210. Pivot connection 276 between popper hook 275 and connector arm 273 allows popper hook 275 to slide past teeth 256 of rack 253.

As illustrated in FIGS. 11 and 12, when front support leg 250 begins to extend after having been compressed, popper hook 275 catches on teeth 256 of rack 253. Popper hook 275 is pulled downward with rack 253 until connector arm 273 extends out of popper well 274 a sufficient distance to pivot popper hook 275 away from rack 253, thereby releasing popper mechanism 270 to be returned to the initial position by springs 271A, 271B, launching balls 227.

Figure 13:
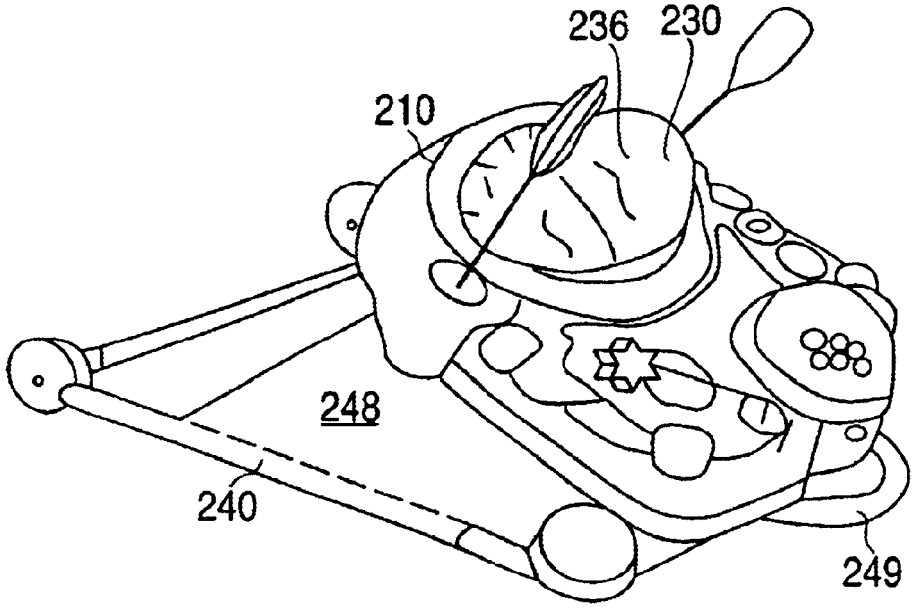
FIG. 13 is perspective view of a device in a second configuration according to an embodiment illustrated in FIG. 3.
Figure 14:
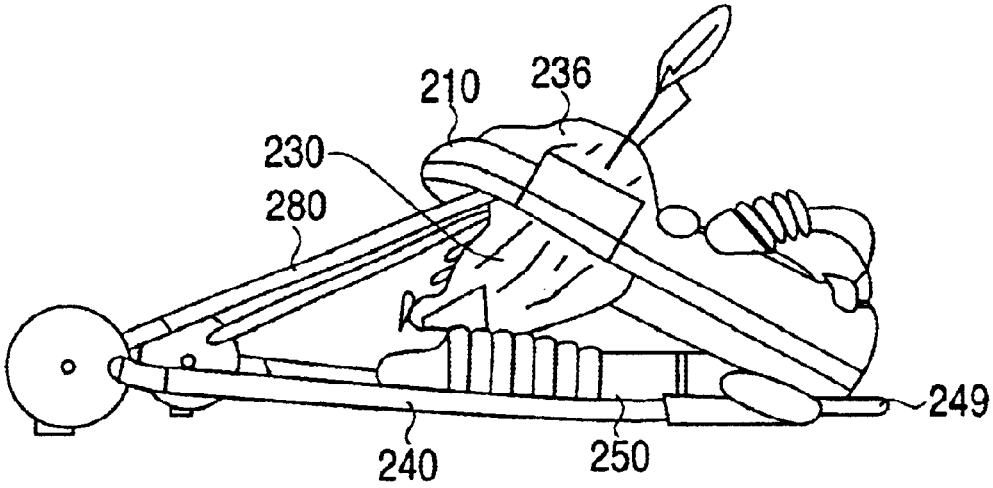
FIG. 14 is a side view of the device illustrated in FIG. 13.

In the illustrated embodiment, actuator arm 278 extends from popper body 272 and out of popper well 274. When popper mechanism 270 returns to the initial position, actuator arm 278 contacts movement actuator 29, thereby activating audio-visual output system AV. Device 200 is collapsible for transport and storage. FIGS. 13 and 14 are perspective illustrations of device 200 is a second, collapsed configuration.

In the collapsed configuration according front support leg 250 is uncoupled from tray 210 by the release mechanism discussed above. Front support leg 250 is then folded to a position substantially planar to base 240. Tray 210, along with rear support 280 is then pivoted about base couplings 244A, 244B into a position substantially planar to base 240. In the collapsed configuration, tray 210 is releasably coupled to front base member 246A, trapping front support leg 250 between tray 210 and child foot shield 248 and disposed between the base members 246B, 246C. Tray 210 is releasably coupled to front base member 246A by a hook and loop fastener strap 111, as shown in FIGS. 9 and 10, attached to tray 210 and wrapped around front base member 246A. Handle 249 in the front base member 246A allows device 200 to be transported easily.

As shown in contrast between FIGS. 5 and 14, when device 200 is in the second collapsed configuration, the profile is much lower, allowing the device 10 to be stored in small areas or easily transported. Foldable support portion 236 of seat 230 folds down in the second configuration for a lower profile when collapsed.

While particular, illustrative embodiments of the invention have been described, numerous variations and modifications exist that would not depart from the scope of the invention. For example, device 200 can be configured to be collapsed using a motor-driven assembly rather than being repositioned manually.

Although actuators 28A, 28B, 29 are described above as mechanical switches, any actuators can be motion detectors, IR switches or other similar actuators to detect motion of portions of device 200 or of a child using device 200. For example, an IR motion detector can be placed in front support leg 250 to detect compression or movement of front support 250. Alternatively, pressure switches can be located in foot guard 248 or other components of device 200. A specific output pattern from output generator 35 can also be uniquely associated with a particular input.

Although the position of the lights 59B is generally illustrated in the Figures, lights and speakers can be placed in various locations on device 200. Portions of base 240 or other portions of tray 210 can be illuminated either randomly or sequentially. Additional speakers can also be used in various locations on device 200 to give the impression of location specific effects.

Although device 200 is described above as having three actuators 28A, 28B, 29 positioned on tray 210, in an alternative embodiment, device 200 can include multiple actuators, including actuators disposed on or beneath foot guard 248, on supplemental toys attached to device 200, or on front support 250.

Although the actuators are described above as causing electronic output, along with the mechanical output of the corn popper, other actuators can output mechanical sounds and visually appealing patterns such as a spinning wheel, a knob with a window, a squeaker button, etc.

Although the various components of device 200 are formed of plastic materials, soft goods and metal tubing, any other material suitable for the intended use can be utilized.

Although tray 210 is illustrated as a tray configuration, in alternative embodiments, tray 210 can be any shape and configuration, such as an animal or other themed shapes and can include removable or collapsible upright members, such as toy bars, with hanging objects and toys at various locations around tray 210 to entertain a child.

Although seat 230 is fixedly coupled to tray 210 as illustrated, seat 230 can be rotatably mounted to tray 210, allowing a child to face different orientations in seat 230.

Although the seat adjustment device 234 as illustrated includes a male clip located at the bottom of the seat 230 with female clips located at different heights up the back of seat 230 for adjusting seat 230, other mechanisms such as hook and loop fastener straps, buckles, snaps, etc., can be used to adjust the seat height.

Although device 200 is shown in the collapsed configuration described above, several alternative ways of collapsing device 200 exist. For example, tray 210 can be pivotably coupled to rear support 280 at tray coupling 214 to allow a complete folding. Tray 210 can also fold around to the bottom of base 240 such foldable portion 236 of seat 230 and tray 210 contact foot guard 248 when collapsed. Front support leg 250 can also be fully pivotably coupled to tray 210 at tray coupling 212 and removably coupled to the front base member 246A at base coupling 242, or pivotably coupled to both front base member 246A and tray 210 with a lockable pivot in front support leg 250 to allow it to fold and collapse the device 10.

Although tray 210 is coupled to front base member 246A in the illustrated collapsed embodiment with a hook and loop type fastener 111 coupled to tray 210, other coupling means can be used. For example, a strap with a buckle, buttons, etc. can be used to secure device 200, with complimentary fasteners on different contacting portions of device 210. Front base member 246A or the bottom of front support leg 250 at base coupling 242 can also include a structure similar to upper engagement member 260 of front support leg 250 to allow tray 210 to couple at or near base coupling 242 in the same manner as tray coupling 212 discussed above.

While particular, illustrative embodiments have been described, numerous variations and modifications exist that would not depart from the scope of the invention.

CONCLUSION

While various embodiments of the invention have been described above, it should be understood that they have been presented by way of example only, and not limitation. Thus, the breadth and scope of the invention should not be limited by any of the above-described embodiments, but should be defined only in accordance with the following claims and their equivalents.

The previous description of the embodiments is provided to enable any person skilled in the art to make or use the invention. While the invention has been particularly shown and described with reference to embodiments thereof, it will be understood by those skilled in the art that various changes in form and details can be made therein without departing from the spirit and scope of the invention.

What is claimed is:

1. An infant support structure, comprising:

a base;

a frame coupled to the base, said frame including a first frame portion and a second frame portion;

a seat coupled to the frame, said seat being moveable relative to the base, the first frame portion being releasably coupled to said seat; and a sensor configured to output a signal associated with a movement of said seat; and an output generating system coupled to said sensor and configured to generate a sensible output based on the signal.

2. The infant support structure of claim 1, wherein said frame is configured to be convertible between a first, deployed configuration and a second, collapsed configuration.

3. The infant support structure of claim 2, wherein said sensor is coupled to the first frame portion and is configured to detect the movement of said seat in the first deployed position.

4. The infant support structure of claim 2, wherein the second frame portion is pivotably coupled to said base and pivotably coupled to said seat.

5. The infant support structure of claim 1, wherein the first frame portion includes a resilient element at least partially supporting said seat.

6. The infant support structure of claim 1, wherein said sensor is configured to detect the movement of said seat relative to said frame.

7. The infant support structure of claim 1, wherein said sensor is configured to detect the movement of said seat relative to said base.

8. The infant support structure of claim 1, wherein said sensor is configured to detect an acceleration applied to at least a portion of said infant support structure.

9. The infant support structure of claim 1, wherein said output generating system is configured to output at least one of a sound, light, or mechanical motion.

10. The infant support structure of claim 1, wherein said output generating system is an electronic system, the electronic system including a predetermined output routine.

11. The infant support structure of claim 1, wherein said output generating system is configured to output a first predetermined routine associated with a magnitude of the movement of said seat, and a second predetermined routine associated with at least one of the magnitude and a frequency of the movement of said seat.

12. The infant support structure of claim 1, wherein the first frame portion is pivotably coupled to said base.

13. The infant support structure of claim 1, the movement being a first movement, wherein the sensor is configured to output a signal associated with a second movement of said seat and said output generating system is configured to generate a sensible output based on the signal associated with the second movement, the sensible output associated with the second movement being different from the sensible output associated with the first movement.

14. A frame, comprising:

a base;

a front support pivotably coupled to said base, said front support including a resilient member;

a rear support pivotably coupled to said base; and an infant support, said infant support being releasably coupled to said front support and pivotably coupled to said rear support.

15. The frame of claim 14, wherein the frame is configured to be in an extended configuration when said front support is coupled to said infant support, and the frame is configured to be in a collapsed configuration when the front support is not coupled to said infant support.

16. The frame of claim 14, further comprising an output generating system, said output generating system including a motion sensor configured to output a signal associated with a movement of said infant support, said output generating system configured to generate a sensible output based on the signal.

17. The frame of claim 14, wherein said base includes first and second lateral frame members and a resilient sheet coupled to and stretched between said lateral frame members below said infant support.

18. The frame of claim 17, wherein said front support includes a resilient portion, said front support being configured to fold to a position adjacent said base and under said infant support, said infant support being configured to fold to a position substantially adjacent said base and said first support.

19. A frame, comprising:

a base;

a front support including a first end and a second end, the first end being coupled to said base, said front support being axially adjustable in length between a first, extended configuration and a second, collapsed configuration, and including a biasing member disposed to bias the front support toward the extended configuration;

a rear support coupled to said base;

an infant support coupled to said rear support and coupled to the second end of said front support; and an output generating system operable to generate sensible output and including a sensor operable to detect a change in the length of said front support.

20. The frame of claim 19, wherein the sensor is coupled to said front support.

21. The frame of claim 19, wherein said output generating system is configured to output at least one of a sound, light, or mechanical motion.

22. The frame of claim 21, wherein said output generating system is an electronic system, the electronic system including a predetermined output routine.

23. The frame of claim 19, wherein the first end of said front support is pivotably coupled to said base, said rear support is pivotably coupled to said base, and said infant support is pivotably coupled to said rear support.

24. The frame of claim 23, wherein the frame is configured to be in an extended configuration when said front support is coupled to said infant support, and the frame is configured to be in a collapsed configuration when said front support is not coupled to said infant support.

* * * * *